US011404014B2

(12) United States Patent
Li et al.

(10) Patent No.: US 11,404,014 B2
(45) Date of Patent: Aug. 2, 2022

(54) ARRAY SUBSTRATE HAVING SUB-PIXELS OF THE SAME COLOR OUTPUTTING DIFFERENT VOLTAGES AND DRIVING METHOD THEREOF

(71) Applicant: BOE Technology Group Co., Ltd., Beijing (CN)

(72) Inventors: Pan Li, Beijing (CN); Yongda Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 586 days.

(21) Appl. No.: 16/344,851

(22) PCT Filed: Oct. 23, 2018

(86) PCT No.: PCT/CN2018/111490

§ 371 (c)(1),
(2) Date: Apr. 25, 2019

(87) PCT Pub. No.: WO2019/174238

PCT Pub. Date: Sep. 19, 2019

(65) Prior Publication Data

US 2021/0358431 A1 Nov. 18, 2021

(30) Foreign Application Priority Data

Mar. 16, 2018 (CN) ..... 201810218841.8

(51) Int. Cl.
*G09G 3/36* (2006.01)

(52) U.S. Cl.
CPC ..... *G09G 3/3607* (2013.01); *G09G 3/3648* (2013.01); *G09G 2300/0443* (2013.01)

(58) Field of Classification Search
CPC ..... G09G 3/3607
(Continued)

(56) References Cited

U.S. PATENT DOCUMENTS

2010/0110351 A1 5/2010 Kim et al.
2011/0169871 A1* 7/2011 Suzuki ..... H04N 13/398 345/690

(Continued)

FOREIGN PATENT DOCUMENTS

CN 103676389 A 3/2014
CN 106157915 A 11/2016

(Continued)

OTHER PUBLICATIONS

International Search Report (including English translation) and Written Opinion of PCT/CN2018/111490, dated Jan. 24, 2019.

*Primary Examiner* — Long D Pham
(74) *Attorney, Agent, or Firm* — Fay Sharpe LLP

(57) ABSTRACT

An array substrate, and a driving method and driving device thereof, in the field of display technology. A display device includes an array substrate, including a plurality of pixel units. Each pixel unit includes a first sub-pixel and a second sub-pixel of the same color, the first sub-pixel includes a first pixel electrode (061) and a first common electrode (081), and the second sub-pixel includes a second pixel electrode (062) and a second common electrode (082). In a first stage, a voltage between the first pixel electrode (061) and the first common electrode (081) is greater than a voltage between the second pixel electrode (062) and the second common electrode (082), which optimizes and solves the problem of low fineness of the display picture, and improves the fineness of the display picture.

17 Claims, 8 Drawing Sheets

(58) Field of Classification Search
USPC ..... 345/694
See application file for complete search history.

(56) References Cited

U.S. PATENT DOCUMENTS

| | | | | |
|---|---|---|---|---|
| 2012/0086743 | A1* | 4/2012 | Shiomi | G09G 3/3659 345/694 |
| 2015/0286102 | A1 | 10/2015 | Lo et al. | |
| 2016/0322017 | A1* | 11/2016 | Kang | G02F 1/134309 |
| 2019/0011785 | A1 | 1/2019 | Li et al. | |

FOREIGN PATENT DOCUMENTS

| | | | |
|---|---|---|---|
| CN | 206002819 | U | 3/2017 |
| CN | 107728352 | A | 2/2018 |
| CN | 108389557 | A | 8/2018 |
| JP | 2010134032 | A | 6/2010 |

* cited by examiner

ARRAY SUBSTRATE HAVING SUB-PIXELS OF THE SAME COLOR OUTPUTTING DIFFERENT VOLTAGES AND DRIVING METHOD THEREOF

CROSS-REFERENCE TO RELATED APPLICATION

This application is a 371 of PCT Patent Application Serial No. PCT/CN2018/111490, filed on Oct. 23, 2018, which claims priority to Chinese Patent Application No. 201810218841.8, filed on Mar. 16, 2018 and entitled "DISPLAY DEVICE, AND DRIVING METHOD THEREOF", the entire contents of which are incorporated herein by reference.

TECHNICAL FIELD

The present disclosure relates to display technology, and particularly to an array substrate, and a driving method and device thereof.

BACKGROUND

The existing thin film transistor liquid crystal display (TFT-LCD) generally includes a color filter substrate, an array substrate, and a liquid crystal layer between the color filter substrate and the array substrate.

In the related art, the array substrate of the TFT-LCD includes a plurality of data lines, a plurality of gate lines, and a plurality of common electrode lines which are disposed in an intersecting manner. The data lines, the gate lines, and the common electrode lines divide the array substrate into a plurality of pixel units. Each pixel unit includes a TFT and a pixel electrode. The TFT can load the data signals provided by the data lines to the pixel electrode under the control of the gate lines.

SUMMARY

Embodiments of the present disclosure provide an array substrate, and a driving method and device thereof. The technical solutions are as follows.

In an aspect, there is provided an array substrate, wherein the array substrate comprises a plurality of pixel units, each of the pixel units comprises a first sub-pixel and a second sub-pixel of the same color, the first sub-pixel comprises a first pixel electrode and a first common electrode, and the second sub-pixel comprises a second pixel electrode and a second common electrode. In a first stage in which the pixel unit displays a first gray scale, a voltage between the first pixel electrode and the first common electrode is greater than a voltage between the second pixel electrode and the second common electrode.

Optionally, in a second stage in which the pixel unit displays a second gray scale, a voltage between the first pixel electrode and the first common electrode is greater than or equal to a voltage between the second pixel electrode and the second common electrode; wherein the first gray scale is lower than the second gray scale.

Optionally, in the first stage, the voltage between the first pixel electrode and the first common electrode is less than or equal to Vg, wherein Vg is voltage required when a maximum gray scale is displayed; and in the second stage, the voltage between the first pixel electrode and the first common electrode is equal to Vg.

Optionally in the first stage, the voltage between the second pixel electrode and the second common electrode is 0; and in the second stage, the voltage between the second pixel electrode and the second common electrode is greater than 0.

Optionally, in the first stage, a range of the voltage between the first pixel electrode and the first common electrode is (0, Vs], wherein Vs is voltage required when a displayed gray scale is half of a maximum gray scale; and in the second stage, a range of the voltage between the first pixel electrode and the first common electrode is (Vs, Vg], wherein Vg is voltage required when a maximum gray scale is displayed.

Optionally, a range of the first gray scale is (0, ½p], and a range of the second gray scale is (½p, p], wherein p is the maximum gray scale that the pixel unit is able to display.

Optionally, the first sub-pixel further comprises a first thin film transistor (TFT), wherein a first electrode of the first TFT is connected to a first data line, a second electrode of the first TFT is connected to the first pixel electrode, and a gate electrode of the first TFT is connected to a first gate line, and the second sub-pixel further comprises a second TFT, wherein a first electrode of the second TFT is connected to a second data line, a second electrode of the second TFT is connected to the second pixel electrode, and a gate electrode of the second TFT is connected to a second gate line.

Optionally, the first common electrode is connected to a first common electrode line, and the second common electrode is connected to a second common electrode line; the first sub-pixel and the second sub-pixel meet at least one of the following conditions: the first common electrode line and the second common electrode line are two different common electrode lines; the first data line and the second data line are two different data lines; and the first gate line and the second gate line are two different gate lines.

Optionally, the first data line and the second data line are the same data line; the first gate line and the second gate line are two different gate lines.

Optionally, the first gate line and the second gate line are the same gate line; and the first data line and the second data line are two different data lines.

Optionally polarities of the potentials of the first common electrode and the second common electrode are opposite; and/or absolute values of the potentials of the first common electrode and the second common electrode are not equal.

In another aspect, there is provided a driving method for an array substrate, wherein the array substrate comprises a plurality of pixel units, each of the pixel units comprises a first sub-pixel and a second sub-pixel of the same color, the first sub-pixel comprises a first pixel electrode and a first common electrode, and the second sub-pixel comprises a second pixel electrode and a second common electrode, the first sub-pixel is connected to a first data line, and the second sub-pixel is connected to a second data line. The method comprises: in a first stage in which a first gray scale is displayed, loading data signals to the first data line and the second data line, and loading common electrode signals to the first common electrode and the second common electrode, to enable a voltage between the first pixel electrode and the first common electrode to be greater than a voltage between the second pixel electrode and the second common electrode.

Optionally, the method further comprises: in a second stage in which a second gray scale is displayed, loading data signals to the first data line and the second data line, and loading common electrode signals to the first common electrode and the second common electrode, to enable the voltage between the first pixel electrode and the first common electrode to be greater than or equal to the voltage between the second pixel electrode and the second common electrode; wherein the first gray scale is lower than the second gray scale.

Optionally, potentials of the common electrode signals loaded to the first common electrode and the second common electrode meet at least one of the following conditions: polarities of the potentials of the common electrode signals loaded to the first common electrode and the second common electrode are opposite; and absolute values of the potentials of the common electrode signals loaded to the first common electrode and the second common electrode are not equal.

Optionally, the first data line and the second data line are two different data lines, and loading the data signals to the first data line and the second data line comprises: loading the data signals to the first data line and the second data line in a same period.

Optionally, the first sub-pixel is further connected to a first gate line, the second sub-pixel is further connected to a second gate line, the first gate line and the second gate line are two different gate lines, and in at least one of the first stage and the second stage, the method further comprises: loading a first gate electrode scanning signal to the first gate line in a first scanning period; and loading a second gate electrode scanning signal to the second gate line in a second scanning period.

In yet another aspect, there is provided a driving device for an array substrate, wherein the array substrate comprises a plurality of pixel units, the pixel unit comprises a first sub-pixel and a second sub-pixel, the first sub-pixel comprises a first pixel electrode and a first common electrode, and the second sub-pixel comprises a second pixel electrode and a second common electrode, the first sub-pixel is connected to a first data line, and the second sub-pixel is connected to a second data line. The driving device comprises: a driving circuit, configured to load data signals to the first data line and the second data line and load common electrode signals to the first common electrode and the second common electrode in a first stage in which a first gray scale is displayed, to enable a voltage between the first pixel electrode and the first common electrode to be greater than a voltage between the second pixel electrode and the second common electrode.

In still yet another aspect, there is provided a driving device for an array substrate, wherein the array substrate comprises a plurality of pixel units, the pixel unit comprises a first sub-pixel and a second sub-pixel, the first sub-pixel comprises a first pixel electrode and a first common electrode, and the second sub-pixel comprises a second pixel electrode and a second common electrode; and the driving device comprises a processing component, a memory, and a computer program stored on the memory and executable on the processing component, and the computer program, when executed by the processing component, implements the driving method for an array substrate as described above.

In still yet another aspect, there is provided a computer readable storage medium storing instructions therein, wherein the computer readable storage medium, when operating on a computer, causes the computer to implement the driving method for an array substrate as described above.

In still yet another aspect there is provided a display device, comprising an array substrate and the driving device for an array substrate as described above.

BRIEF DESCRIPTION OF THE DRAWINGS

To describe the technical solutions in the embodiments of the present disclosure more clearly, the following briefly introduces the accompanying drawings required for describing the embodiments. Apparently, the accompanying drawings in the following description show merely some embodiments of the present disclosure, and a person of ordinary skill in the art may still derive other drawings from these accompanying drawings without creative efforts.

DETAILED DESCRIPTION

The present disclosure will be described in further detail with reference to the accompanying drawings, to present the objects, technical solutions, and advantages of the present disclosure clearer.

The image display principle of the TFT-LCD is to apply a electrical signal to the common electrode plate on a color filter substrate and pixel electrodes on the array substrate respectively, and to control the deflection angle of liquid crystal molecules by controlling the magnitude of an electric field formed between the common electrode plate and the pixel electrodes, so as to control the amount of transmitted light to achieve display.

In the related art, the TFT of each pixel unit is disposed at the intersection of a gate line and a data line. A source electrode of the TFT is connected to a data line, a gate electrode of the TFT is connected to a gate line, and a drain electrode of the TFT is connected to the pixel electrode. A common electrode lead pad is disposed for the common electrode line, and the common electrode lead pad and the drain electrode of the TFT of the pixel unit form a storage capacitor. After the potential loaded to the common electrode lead pad is changed through the common electrode line, the magnitude of the electric field formed between the pixel electrode and the common electrode plate can be changed. In order to realize the change of colors of the picture when the image is displayed, it is necessary to perform control of the different brightness and darkness on each pixel unit. The more levels of the brightness and darkness are, the finer the display picture is.

However, in the related art, each pixel unit only includes one pixel electrode. When an image is displayed, the liquid crystal molecules of the same pixel unit have the same deflection angle, and thus the pixel unit has fewer levels of brightness and darkness, and the fineness of the display picture is relatively low.

Figure 1:
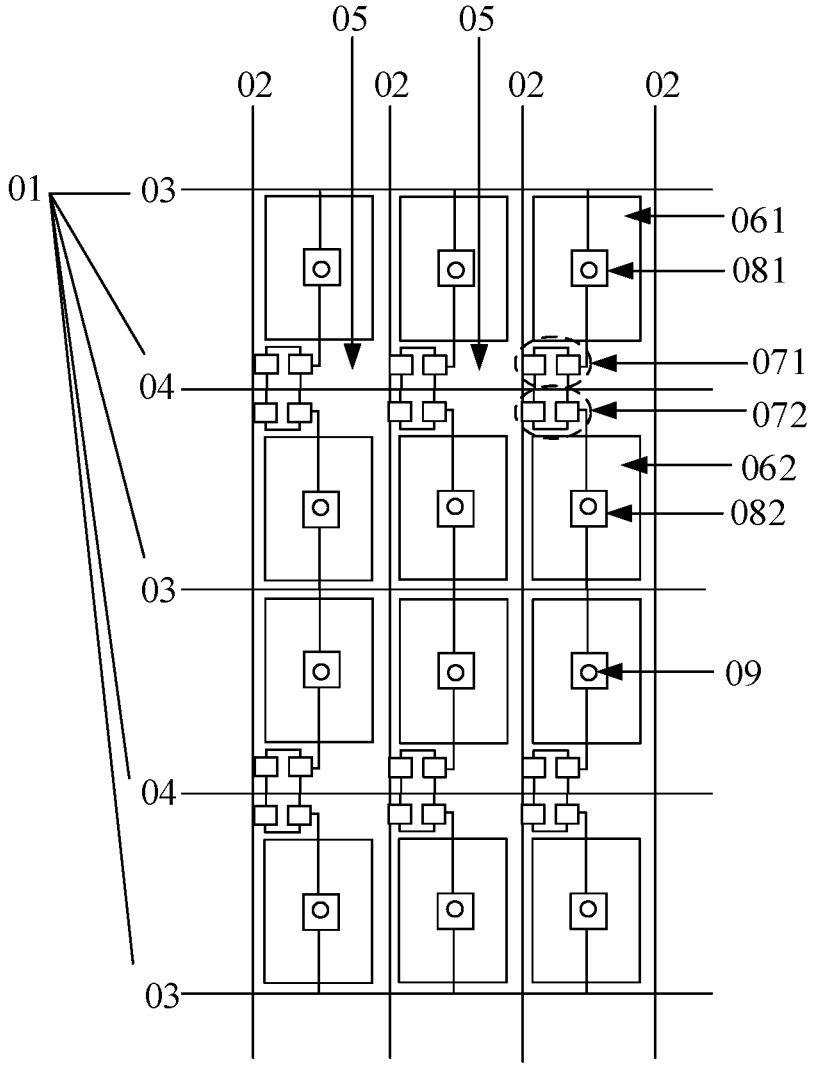
FIG. 1 is a structural schematic diagram of an array substrate of a display device according to an embodiment of the present disclosure.

An embodiment of the present disclosure provides an array substrate. As shown in FIG. 1, the array substrate includes a plurality of pixel units. Each of the pixel units includes a first sub-pixel and a second sub-pixel of the same color. The first sub-pixel includes a first pixel electrode 061 and a first common electrode 081, and the second sub-pixel includes a second pixel electrode 062 and a second common electrode 082.

In the first stage in which a first gray scale is displayed, the voltage between the first pixel electrode 061 and the first common electrode 081 is greater than the voltage between the second pixel electrode 062 and the second common electrode 082.

In the embodiment of the present disclosure, the common electrode included in each sub-pixel may refer to a common electrode lead pad, which may also be referred to as a common electrode lead block, connected to a common electrode line. The common electrode may be an electrode plate in the sub-pixel for forming a storage capacitor. For example, the common electrode may form a storage capacitor with the second electrode of the TFT in the sub-pixel or the pixel electrode. Therefore, by changing the potential of the common electrode in the sub-pixel, the potential of the pixel electrode in the sub-pixel can be changed, and thus the voltage between the pixel electrode and the common electrode plate can be changed. That is, for each sub-pixel, when the voltage between the pixel electrode and the common electrode changes, the voltage between the pixel electrode and the common electrode plate on the color filter substrate also changes, thereby driving the deflection angle of the liquid crystal molecules to change. Finally, the displayed gray scale of the sub-pixel changes.

In the embodiment of the present disclosure, the data voltage finally loaded to the liquid crystal molecules by each pixel unit may be equivalent to an average value of the two voltages (that is, the voltage between the first pixel electrode 061 and the first common electrode 081 and the voltage between the second pixel electrode 062 and the second common electrode 082). If the adjustment dimension (i.e., the minimum adjustment unit) of the voltage between the pixel electrode and the common electrode in each sub-pixel is a, then when the voltages between the pixel electrodes and the common electrodes of the two sub-pixels in each pixel unit are not equal, the adjustment dimension of the average value of the voltages of the two sub-pixels can be reduced to a/2. Therefore, fine adjustment of the brightness and darkness of each pixel unit can be realized, thereby enriching the change levels of the brightness and darkness of the pixel unit, and improving the fineness of the display picture.

For example, it is assumed that the adjustment dimension of the voltage between the pixel electrode and the common electrode in each sub-pixel is 1V (volt), the voltage between the first pixel electrode 061 and the first common electrode 081 in the first sub-pixel is 3V. and the voltage between the second pixel electrode 062 and the second common electrode 082 in the second sub-pixel pixel is 2V, then the data voltage finally loaded to the liquid crystal molecules by each pixel unit may be 2.5V. It can be seen that the adjustment dimension of the data voltage is reduced to 0.5V, and the fine adjustment of the brightness and darkness of the pixel unit is achieved.

Similarly, the gray scale actually displayed by each pixel unit may be the average value of the gray scales displayed by the two sub-pixels. If the adjustment dimension of the gray scale of each sub-pixel is b, then when the voltages between the pixel electrodes and common electrodes of the two sub-pixels are not equal, the gray scales displayed by the two sub-pixels are not equal either. In this case, the adjustment dimension of the average value of the gray scales displayed by the two sub-pixels can be reduced to b/2. For example, at present, the adjustment dimension of the gray scale of each pixel unit is generally 1, and the adjustment dimension of the gray scale of each pixel unit can be reduced to 0.5 with the solutions provided by the embodiment of the present disclosure. Therefore, the fine adjustment of the brightness and darkness of each pixel unit is achieved, and the fineness of the display picture is improved.

FIG. 1 illustratively shows a structural schematic diagram of an array substrate of a display device according to an embodiment of the present disclosure. As shown in FIG. 1, the array substrate includes a plurality of signal lines 01 parallel to each other and a plurality of data lines 02 parallel to each other, and any one of the signal lines 01 intersects with any one of the data lines 02. The plurality of signal lines 01 includes a plurality of common electrode lines 03 and a plurality of gate lines 04 which are arranged alternately. The plurality of signal lines 01 and the plurality of data lines 02 define a plurality of display areas 05 arranged in an array. Each display area 05 is provided with a pixel electrode (for example, a pixel electrode 061), and a TFT (for example, a TFT 071) is disposed at an intersection of the gate line 04 and the data line 02 in each display area 05. The first electrode of the TFT is connected to the data line 02, the gate electrode of the TFT is connected to the gate line 04, and the second electrode of the TFT is connected to the pixel electrode in the same display area. For example, the second electrode of the TFT may be connected to the pixel electrode through a via hole 9.

In FIG. 1, each display area corresponds to one sub-pixel. In the plurality of sub-pixels defined by the intersecting signal lines 01 and data lines 02, the adjacent n sub-pixels have the same color, and the n sub-pixels of the same color may belong to the same pixel unit. That is, the plurality of pixel units in the array substrate may be divided into a plurality of groups, and each group of pixel units may include a plurality of adjacent pixel units of different colors. Each pixel unit is configured to emit light of one color, such as red light, blue light or green light. Each pixel unit includes n sub-pixels of the same color. That is, the n sub-pixels included in each pixel unit may emit light of the same color, where $n \geq 2$. For example, each group of pixel units may include: a red pixel unit, a green pixel unit, and a blue pixel unit, and each pixel unit may include two (i.e., n=2) sub-pixels of the same color.

In the embodiment of the present disclosure, the first electrode of the TFT may be a source electrode, and the second electrode of the TFT may be a drain electrode.

The common electrode line in each display area and the second electrode of the TFT in the same display area form a storage capacitor. For example, the common electrode line 03 in each sub-pixel may be provided with a common electrode lead pad, such as the common electrode lead pads 081 and 082 as shown in FIG. 1. The common electrode lead pad forms a storage capacitor with the second electrode of the TFT in the same display area. The common electrode lead pad is also referred to as a common electrode in the embodiment of the present disclosure.

It can be seen with reference to FIG. 1 that each common electrode line 03 may be connected to a plurality of common electrode lead pads. The orthographic projection of each via hole 09 on the base substrate of the array substrate may be within the orthographic projection of the common lead pad on the base substrate. Of course, the orthographic projection of the via hole 09 on the base substrate may not overlap with the orthographic projection of the common lead pad on the base substrate, which is not limited in the embodiment of the present disclosure.

Of course, the storage capacitor of each sub-pixel is not limited to the storage capacitor formed by the common electrode line and the second electrode of the TFT in the same display area, and the storage capacitor may be formed in other ways. For example, the common electrode line may form the storage capacitor with the pixel electrode in the same display area, or the common electrode line, the pixel electrode, and the second electrode of the TFT in the same display area may form the storage capacitor.

In the embodiment of the present disclosure, each sub-pixel includes a pixel electrode, and the plurality of pixel electrodes in the same pixel unit may be in the same column or may be located in the same row.

FIG. 1 illustratively shows that each pixel unit includes two sub-pixels: the first sub-pixel and the second sub-pixel. The first sub-pixel includes a first pixel electrode 061, a first TFT 071, and a first common electrode 081. The second sub-pixel includes a second pixel electrode 062, a second TFT 072 and a second common electrode 082. It can be seen from FIG. 1 that the first pixel electrode 061 and the second pixel electrode 062 in the same pixel unit are in the same column.

The first electrode of the first TFT 071 is connected to the first data line, the second electrode of the first TFT 071 is connected to the first pixel electrode 061, and the gate electrode of the first TFT 071 is connected to the first gate line.

The first electrode of the second TFT 072 is connected to the second data line, the second electrode of the second TFT 072 is connected to the second pixel electrode 062, and the gate electrode of the second TFT 072 is connected to the second gate line. The first common electrode 081 may be connected to a first common electrode line. The second common electrode 082 may be connected to a second common electrode line.

In the embodiment of the present disclosure, the first sub-pixel and the second sub-pixel may meet at least one of the following conditions.

The first common electrode line and the second common electrode line are two different common electrode lines.

The first data line and the second data line are two different data lines.

The first gate line and the second gate line are two different gate lines.

Exemplarily, the second common electrode line and the first common electrode line are two different common electrode lines. For example, as shown in FIG. 1, the first pixel unit in the array substrate may include a first sub-pixel in the first column and the first row, and a second sub-pixel in the first column and the second row. The first common electrode line connected to the first sub-pixel is the first common electrode line 03 from the top, the second common electrode line connected to the second sub-pixel is the second common electrode line 03 from the top, and the common electrode lines of the two sub-pixels are different common electrode lines.

Exemplarily, the first data line connected to the first sub-pixel and the second data line connected to the second sub-pixel may be the same data line, and the first gate line connected to the first sub-pixel and the second gate line connected to the second sub-pixel may be the same gate line. For example, referring to FIG. 1, the first electrode of the first TFT 071 and the first electrode of the second TFT 072 may be connected to the same data line 02, and the gate electrode of the first TFT 071 and the gate electrode of the second TFT 072 may be connected to the same gate line 04.

In the embodiment of the present disclosure, the voltage of the data line and the voltage of the common electrode line are superimposed, such that the voltage between the first pixel electrode 061 and the first common electrode 081 and the voltage between the second pixel electrode 062 and the second common electrode 082 are different. Since the voltage between the first pixel electrode 061 and the first common electrode 081 and the voltage between the second pixel electrode 062 and the second common electrode 082 are different, the deflection angle of the liquid crystal molecules in the first sub-pixel and the deflection angle of the liquid crystal molecules in the second sub-pixel of the are different, so that in each pixel unit, the deflection angle of a part of the liquid crystal molecules is different from the deflection angle of the other part of liquid crystal molecules. Thus, the change dimension of the average deflection angle of the liquid crystal molecules in each pixel unit can be reduced, thereby increasing the levels of the brightness and darkness of the pixel unit, and improving the fineness of the display picture.

It can be understood that the pixel unit actually displays the effect of mixed light of the first sub-pixel and the second sub-pixel, That is, the gray scale p0 actually displayed by the pixel unit is half of the sum of the gray scale p1 displayed by the first sub-pixel and the gray scale p2 displayed by the second sub-pixel, that is, p0 meets: $p0=(p1+p2)/2$.

In the first stage, the voltage between the first pixel electrode 061 and the first common electrode 081 may be greater than the voltage between the second pixel electrode 062 and the second common electrode 082.

Optionally, in the first stage, the potential of the first common electrode 081 may be lower than the potential of the second common electrode 082, and the potential of the first pixel electrode 061 is equal to the potential of the second pixel electrode 062. Thus, the voltage between the first pixel electrode 061 and the first common electrode 081 may be greater than the voltage between the second pixel electrode 062 and the second common electrode 082.

Optionally, in the second stage, the voltage between the first pixel electrode 061 and the first common electrode 081 may be greater than or equal to the voltage between the second pixel electrode 062 and the second common electrode 082.

The first stage may be a stage in which a first gray scale is displayed, the second stage may be a stage in which a second gray scale is displayed, and the first gray scale is lower than the second gray scale. Since the gray scale displayed by each pixel unit is determined according to the picture actually displayed by the display device, the stage in which each pixel unit is in is also determined according to the picture actually displayed.

Exemplarily, the range of the first gray scale may be $(0, \frac{1}{2}p]$, and the range of the second gray scale may be $(\frac{1}{2}p, p]$, wherein p is the maximum gray scale when the display device performs display, that is the maximum gray scale that the pixel unit is able to display.

In the embodiment of the present disclosure, for any of the first stage and the second stage, the difference between the voltage V1 between the first pixel electrode 061 and the first common electrode 081 and the voltage V2 between the second pixel electrode and the second common electrode 082 can be flexibly adjusted, as long as it can be guaranteed that the average value of the gray scales of the two sub-pixels is equal to the gray scale actually required to be displayed by the pixel unit.

If the range of the first gray scale is (0, ½p], and the range of the second gray scale is (½p,p], in the first stage in which the first gray scale is displayed, the data voltage Vd of the pixel unit corresponding to the actually displayed picture meets: Vd≤Vs. Vs is the voltage required when the gray scale displayed by the sub-pixel is half of the maximum gray scale. Then, in the first stage, the voltage between the first pixel electrode 061 and the first common electrode 081 is less than or equal to Vg, which is the maximum gray scale voltage when the display device performs display, that is, the voltage required when the maximum gray scale is displayed. Here, the voltage between the second pixel electrode 062 and the second common electrode 082 may be less than Vs. For example, the voltage between the second pixel electrode 062 and the second common electrode 082 may be equal to 0. In this case, only the first sub-pixel emits light, and the second sub-pixel does not emit light.

In the second stage in which the second gray scale is displayed, the data voltage Vd of the pixel unit corresponding to the actually displayed picture meets: Vd>Vs. Then, in the second stage, the voltage V1 between the first pixel electrode 061 and the first common electrode 081 may be equal to Vg. Exemplarily, Vg may be equal to 8V. Here, the first sub-pixel displays the maximum brightness, that is, the maximum gray scale p. According to the above formula of the gray scale p0 actually displayed by the pixel unit: p0=(p1+p2)/2, it can be known that the gray scale p2 displayed by the second sub-pixel should be: p2=2p0−p. Therefore, in this case, the voltage V2 between the second pixel electrode 062 and the second common electrode 082 may be the voltage required when the displayed gray scale is p2.

Since the gray scale p0 actually displayed by the pixel unit is greater than ½p in the second stage, p2 is also greater than 0. Therefore, the voltage between the second pixel electrode 062 and the second common electrode 082 is greater than 0, That is, in the second stage, both the first sub-pixel and the second sub-pixel emit light.

Figure 2:
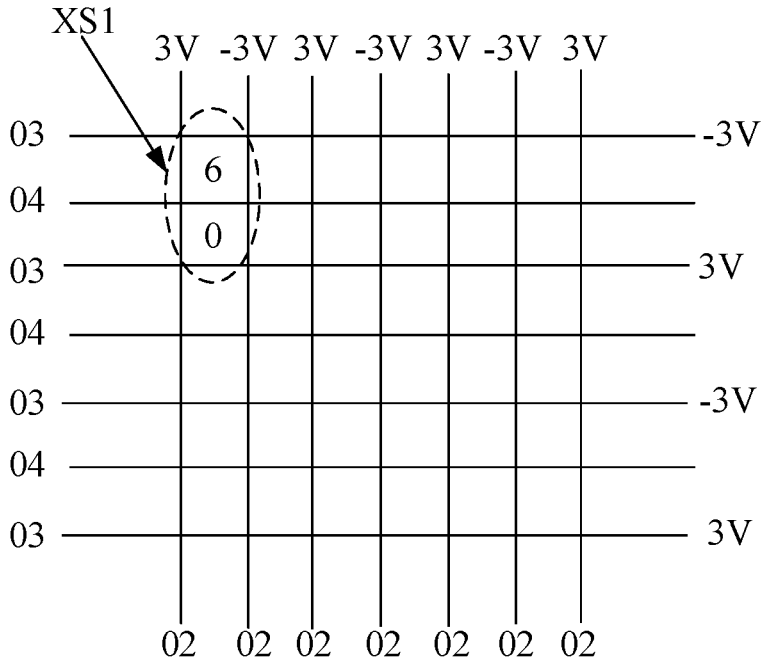
FIG. 2 is a schematic diagram of a voltage between a pixel electrode and a common electrode according to an embodiment of the present disclosure.

Exemplarily, it is assumed that the voltage between the pixel electrode and the common electrode is 6V, the liquid crystal is completely deflected, that is, the maximum gray scale voltage Vg=6V. Referring to FIG. 2, there are seven data lines 02, four common electrode lines 03, and three gate lines 04 in the array substrate. In the first stage in which the first pixel unit XS1 displays the first gray scale, the potentials of the data signals loaded on the seven data lines from left to right are: 3V, −3V, 3V, −3V, 3V, −3V, 3V respectively. The potentials of the common electrode signals loaded on the four common electrode lines from top to bottom are: −3V, +3V, −3V, +3V respectively.

It is assumed that the first electrode of the first TFT and the first electrode of the second TFT of the first pixel unit XS1 are both connected to the first data line 02 from the left, the gate electrode of the first TFT and the gate electrode of the second TFT are both connected to the first gate line 04 from the top, the first common electrode 081 is connected to the first common electrode line 03 from the top, and the second common electrode 082 is connected to the second common electrode line 03 from the top. It can be seen from FIG. 2 that the potential of the data signal loaded on the first data line 02 from the left is 3V, the potential of the common electrode signal loaded on the first common electrode line 03 from the top is −3V, and the potential of the common electrode signal loaded on the second common electrode line 03 from the top is 3V.

Then, for the first pixel unit XS1, in the first stage in which the first gray scale is displayed, the voltage V1 between the first pixel electrode 061 and the first common electrode 081 in the first sub-pixel of the pixel unit XS1 is: 3−(−3)=6V. The voltage V2 between the second pixel electrode 062 and the second common electrode 082 in the second sub-pixel is: 3−(+3)=0V. In this case, the gray scale actually displayed by the pixel unit XS1 is half of the sum of the gray scale corresponding to 6V (i.e., the maximum gray scale p) and the gray scale corresponding to 0V (i.e., the minimum gray scale 0), that is, in this case, the gray scale displayed by the pixel unit XS1 is ½p.

According to the above analysis, it can be known that in the first stage, the voltage between the first pixel electrode and the first common electrode is greater than the voltage between the second pixel electrode and the second common electrode, and the two voltage differences are different. Similarly, in the other pixel units, the voltage between the first pixel electrode and the first common electrode is also different from the voltage between the second pixel electrode and the second common electrode, and thus the levels of the brightness and darkness of each pixel unit increase.

Optionally, in the embodiments of the present disclosure, the common electrode potential of the first sub-pixel (i.e., the potential of the first common electrode) and the common electrode potential of the second sub-pixel (i.e., the potential of the second common electrode) are opposite in polarity and equal in absolute value.

When the polarities of the potentials of the two common electrodes in the same pixel unit are opposite, the data line connected to the pixel unit only needs to provide a data signal of a relatively low potential to achieve a relatively big potential difference, thereby reducing the power consumption of the array substrate. For example, when the potential of the first common electrode is 3V and the potential of the second common electrode is −3V, the data line only needs to provide the data signal of which the voltage alternately changes from 3V to −3V, so that the voltage between the pixel electrode and the common electrode of one sub-pixel reaches 6V.

Optionally, in the first stage, if the first gray scale to be displayed by the pixel unit is p0, then the voltage V1 between the first pixel electrode and the first common electrode of the first sub-pixel may be the voltage required when the displayed gray scale is 2p0, and the voltage V2 between the second pixel electrode and the second common electrode of the second sub-pixel may be equal to 0. In this case, the first gray scale displayed by the second sub-pixel may be 0. That is, the gray scale p0 actually displayed by the pixel unit is: p0=(2p0+0)/2=p0.

When entering the second stage from the first stage, for example, when the data voltage of the pixel unit corresponding to the actually displayed picture changes from Vd≤Vs to Vd>Vs, the potential of the common electrode signal loaded on one of the two adjacent common electrode lines may keep V0 without change. The potential of the data signal loaded by the data line may be determined according to the maximum gray scale voltage Vg, and the potential of the data signal may be: Vg+V0. That is, the voltage between the pixel electrode and the common electrode in one sub-pixel in the pixel unit is Vg, and the gray scale p1 displayed by the sub-pixel is the maximum gray scale p. The potential of the common electrode signal loaded on the other common electrode line may be determined according to the gray scale p0 actually displayed by the pixel unit. According to the formula of the gray scale p0 actually displayed by the pixel unit: p0=(p1+p2)/2, it can be deduced that the gray scale displayed by the other sub-pixel should meet: p2=2p0−p. Therefore, the potential of the common electrode signal loaded on the other common electrode line may be: Vg+V0−Vp, and Vp is the voltage required when the displayed gray scale is p2, that is, the voltage difference of the other sub-pixel is Vp.

For example, it is assumed that the gray scale displayed by the sub-pixel is linearly related to the voltage of the sub-pixel (i.e., the voltage between the pixel electrode and the common electrode), that is, Vd meets: Vd=(V1+V2)/2, then the voltage V2 of another sub-pixel meets: V2=2Vd−Vg. Hence, it can be deduced that in the second stage, the potential of the common electrode signal loaded on the other common electrode line is: Vg+V0−(2Vd−Vg)=2Vg−2Vd+V0. In the case of Vg=8V and the data voltage Vd in the second stage is equal to 6V, if the potential of the common electrode signal loaded on the first common electrode line keeps at V0=−3V, the potential of the data signal loaded on the data line should become: 8+(−3)=5V, and the potential of the common electrode signal loaded on the second common electrode line should become: 2×8−2×6+(−3)=1V. That is, the potentials of the common electrode signals loaded on the four common electrode lines from top to bottom are: −3V; +1V, −3V, +1V respectively. Then, for the first pixel unit XS1, the voltage between the first pixel electrode and the first common electrode in the first sub-pixel of the pixel unit XS1 is: 5−(−3)=8V, and the voltage between the second pixel electrode and the second common electrode in the second sub-pixel is: 5−(+1)=4V.

The voltage between the first pixel electrode and the first common electrode may only reach the maximum gray scale voltage Vg=8 V after the first pixel unit XS1 has been charged for a certain duration. In this process, the voltage between the first pixel electrode and the first common electrode is greater than the voltage between the second pixel electrode and the second common electrode. When the voltage between the first pixel electrode and the first common electrode reaches Vg, the voltage between the second pixel electrode and the second common electrode of the second sub-pixel is (2Vd−Vg). Thus, the pixel unit displays Vd=½(Vg+(2Vd−Vg)). That is, the first sub-pixel may be charged to the maximum gray scale, and the second sub-pixel is charged according to the data voltage Vd of the actually displayed picture. Similarly, in other pixel units, the voltage between the first pixel electrode and the first common electrode is also different from the voltage between the second pixel electrode and the second common electrode, so the levels of the brightness and darkness of each pixel unit increase.

Optionally, the data lines of adjacent pixel units have opposite polarities. That is, the polarities of the potentials of the data signals loaded on the data lines connected to the adjacent pixel units are opposite. For example, in the structure shown in FIG. 2, the potential of the data signal loaded on the first data line from the left is 3V, and the potential of the data signal loaded on the second data line is −3V.

Optionally, the first sub-pixels of adjacent two columns or two rows share one common electrode line; or the second sub-pixels of adjacent two columns or two rows share one common electrode line. For example, when the two common electrodes of the same pixel unit are located in the same column, the adjacent two columns of sub-pixels may share one common electrode line, that is, the plurality of sub-pixels located in the same row may share one common electrode line. When the two common electrodes of the same pixel unit are located in the same row, the adjacent two rows of sub-pixels may share one common electrode line, that is, the plurality of sub-pixels located in the same column may share one common electrode line. In this way, respective sub-pixels of the same pixel unit correspond to different common electrode lines respectively, which can achieve the independent adjustment of the voltage between the pixel electrode and the common electrode of each sub-pixel more easily.

Optionally, at least one of the potentials of the common electrode signals loaded on the first common electrode line and the second common electrode line presents a periodic change in the first stage and the second stage. For example, the potential of the common electrode signal loaded on the first common electrode line is −3V in the first stage and 3V in the second stage. Alternatively, the potential of the common electrode signal loaded on the second common electrode line is 3V in the first stage and is 2V in the second stage.

Optionally, the difference between the absolute value of the potential of the common electrode signal loaded on the first common electrode line and the absolute value of the potential of the common electrode signal loaded on the second common electrode line may be not be the same in the first stage and in the second stage. For example, in the first stage, the difference between the absolute values of the potentials of the common electrode signals loaded on the first common electrode line and the second common electrode line may be 6V, and in the second stage, the difference between the absolute values of the potentials of the common electrode signals loaded on the first common electrode line and the second common electrode line may be 4V.

Optionally, in the first stage, assuming that the first gray scale actually to be displayed by the pixel unit is p0, then the range of difference between the voltage between the first pixel electrode and the first common electrode and the voltage between the second pixel electrode and the second common electrode is (0, Vg], or (0, Vc], wherein Vc is the voltage required when the gray scale displayed by the sub-pixel is 2p0. For example: it is assumed that Vg=8V, in the first stage, the voltage between the first pixel electrode and the first common electrode is 4V, the voltage between the second pixel electrode and the second common electrode is 0V, and the difference between the two voltage differences is 4V, which is less than Vg.

Exemplarily, the range of difference between the voltage between the first pixel electrode and the first common electrode and the voltage between the second pixel electrode and the second common electrode may be [2, Vg]. For example, the difference between the voltage between the first pixel electrode and the first common electrode and the voltage between the second pixel electrode and the second common electrode may be Vs. Alternatively, the voltage between the first pixel electrode and the first common electrode is 1.5 to 4 times of the voltage between the second pixel electrode and the second common electrode. For example, it is assumed that Vg is equal to 8V. In the first stage in which the first gray scale is displayed, the voltage between the first pixel electrode and the first common electrode is 6V, the voltage between the second pixel electrode and the second common electrode is 1.5V, and the voltage between the first pixel electrode and the first common electrode is 4 times of the voltage between the second pixel electrode and the second common electrode.

Optionally, in the second stage in which the second gray scale is displayed, the data voltage Vd of the pixel unit corresponding to the picture actually displayed may meet: Vd>Vs. The range of the voltage between the first pixel electrode and the first common electrode may be (Vs, Vg]. The range of the voltage between the second pixel electrode and the second common electrode may be (Vs, Vg] or (0, Vp is the voltage required when the gray scale displayed by the sub-pixel is 2p0−p.

That is, when the second gray scale is displayed, both the first sub-pixel and the second sub-pixel may emit light, and the pixel unit actually displays the effect of mixed light of the first sub-pixel and the second sub-pixel. Optionally, in the second stage, the voltage V1 between the first pixel electrode and the first common electrode may be equal to the voltage V2 between the second pixel electrode and the second common electrode. In this case, the range of the voltage between the two sub-pixels is (Vs, Vg]. Alternatively, the voltage V1 between the first pixel electrode and the first common electrode may be Vg, that is, the gray scale displayed by the first sub-pixel is p, and in this case, the voltage V2 between the second pixel electrode and the second common electrode is Vp.

Of course, in the embodiment of the present disclosure, there may only exists the first stage, that is, all pixel units only display the first gray scale.

Referring to FIG. 2, there are four common electrode lines 03 and three gate lines 04 in the array substrate. In the second stage in which the pixel unit XS1 displays the second gray scale, the potentials of the data signals loaded on the seven data lines from left to right are: 3V, −3V, 3V, −3V, 3V, −3V, 3V respectively. The potentials of the common electrode signals loaded on the four common electrode lines from top to bottom are: −3V, 1V, −3V, 1V respectively. Then, for the first pixel unit XS1, the voltage between the first pixel electrode and the first common electrode in the first sub-pixel of the pixel unit XS1 is: 3−(−3)=6V, and the voltage between the second pixel electrode and the second common electrode in the second sub-pixel is: 3−(1)=2V. The voltage between the first pixel electrode and the first common electrode is greater than the voltage between the second pixel electrode and the second common electrode, and the two voltage differences are different. Similarly, the voltage between the first pixel electrode and the first common electrode and the voltage between the second pixel electrode and the second common electrode in other pixel units are also different, so the levels of the brightness and darkness of each pixel unit increase.

Figure 3:
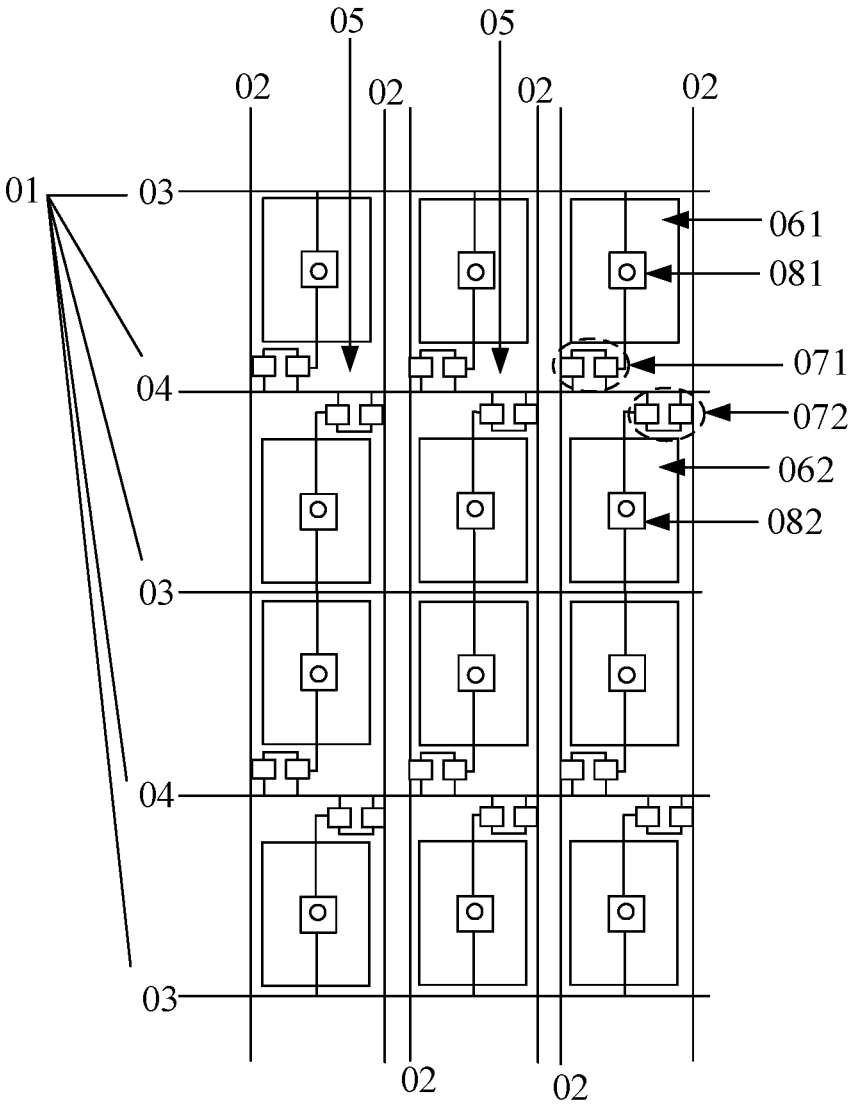
FIG. 3 is a structural schematic diagram of another array substrate of a display device according to an embodiment of the present disclosure.

FIG. 3 is a structural schematic diagram of another array substrate of a display device according to an embodiment of the present disclosure. The array substrate has a double-data line structure, and the pixel unit included in the array substrate may include two sub-pixels: a first sub-pixel and a second sub-pixel. As shown in FIG. 3, the first sub-pixel includes a first pixel electrode 061, a first TFT 071, and a first common electrode 081, and the second sub-pixel includes a second pixel electrode 062, a second TFT 072, and a second common electrode 082.

The first electrode of the first TFT 071 is connected to the first data line, the second electrode of the first TFT 071 is connected to the first pixel electrode 061, and the gate electrode of the first TFT 071 is connected to the first gate line.

The first electrode of the second TFT 072 is connected to the second data line, the second electrode of the second TFT 072 is connected to the second pixel electrode 062, and the gate electrode of the second TFT 072 is connected to the second gate line. The first common electrode 081 may be connected to a first common electrode line, and the second common electrode 082 may be connected to a second common electrode line. Exemplarily, the second common electrode line and the first common electrode line are two different common electrode lines.

Exemplarily, the first data line connected to the first sub-pixel and the second data line connected to the second sub-pixel may be two different data lines, the first gate line connected to the first sub-pixel and the second gate line connected to the second sub-pixel may be the same gate line. That is, the first electrode of the first TFT 071 and the first electrode of the second TFT 072 may be connected to different data lines 02, and the first TFT 071 and the second TFT 072 are located between the first data line and the second data line. The gate electrode of the first TFT 071 and the gate electrode of the second TFT 072 may be connected to the same gate line 04.

In the first stage in which the first gray scale is displayed, the voltage between the first pixel electrode 061 and the first common electrode is greater than the voltage between the second pixel electrode 062 and the second common electrode.

Optionally, in the second stage in which the second gray scale is displayed, the voltage between the first pixel electrode 061 and the first common electrode may be greater than or equal to the voltage between the second pixel electrode 062 and the second common electrode.

For example, in the first stage, the range of the voltage between the first pixel electrode 061 and the first common electrode is (0, Vs]. In the second stage, the range of the voltage between the first pixel electrode 061 and the first common electrode may be (Vs, Vg], and the range of the voltage between the second pixel electrode and the second common electrode may be (Vs, Vg].

For example, it is assumed that the maximum gray scale voltage when the display device performs display is a 256-bit gray scale voltage. In the first stage, when the gray scale picture with the gray scale of 0~127 is realized, that is, Vd≤Vs, the data signal may be only loaded to the first data line, to provide a voltage signal to the first pixel electrode 061. Alternatively, the data signal may be simultaneously loaded to the first data line and the second data line, to charge the first pixel electrode 061 and the second pixel electrode 062. In this case, the range of the voltage V1 between the first pixel electrode 061 and the first common electrode 081 may be (0, Vc], or (0, Vg]. When the voltage V2 between the second pixel electrode 062 and the second common electrode 082 is greater than or equal to 0, the range of the voltage V1 between the first pixel electrode 061 and the first common electrode may be (0, Vs], that is, the first sub-pixel and the second sub-pixel may emit light at the same time.

In the second stage, when the gray scale picture with the gray scale of 128~255 is realized, that is, Vd>Vs, the data signal may be respectively loaded to the first data line and the second data line, to provide the first pixel electrode with the voltage signal by the first data line, so that the range of the voltage between the first pixel electrode 061 and the first common electrode 081 is (Vs, Vg]. The voltage signal is provided to the second pixel electrode by the second data line, so that the pixel unit realizes the picture display of the corresponding gray scale. For example, assuming that the second gray scale actually to be displayed by the pixel unit in the second stage is p0, then the voltage V1 between the first pixel electrode 061 and the first common electrode 081 may be enabled to be equal to Vg, and thus the first sub-pixel realizes the picture display of the maximum brightness, that is, displays the maximum gray scale p. The voltage V2 between the pixel electrode 062 and the second common electrode 082 is a voltage required to display the gray scale 2p0−p, and the gray scale displayed by the second sub-pixel is 2p0−p. Thus, the second gray scale p0 actually displayed by the pixel unit is p0=(p+2p0−p)/2=p0.

Optionally, in the embodiment of the present disclosure, when the first data line and the second data line are two different data lines, the potentials of the common electrode signals loaded to the first common electrode line and the second common electrode line may be equal, that is, the potential of the first common electrode is equal to the potential of the second common electrode. In this case, the voltages of the data signals loaded on the two data lines may be adjusted, such that the voltage between the first pixel electrode and the first common electrode is greater than or equal to the voltage between the second pixel electrode and the second common electrode.

Optionally, in at least one of the first stage and the second stage, the voltage of the first pixel electrode 061 is equal to the voltage of the second pixel electrode 062, for example, in the second stage.

Alternatively, in at least one of the first stage and the second stage, the voltage of the first common electrode 081 is equal to the voltage of the second common electrode 082, for example, in the first stage.

Optionally, in the second stage, the voltage between the first pixel electrode 061 and the first common electrode 081 may also be greater than or equal to the voltage between the second pixel electrode 062 and the second common electrode 082.

Optionally, at least one of the potentials of the common electrode signals loaded on the first common electrode line and the second common electrode line presents a periodic change in the first stage and the second stage. For example, the potential of the common electrode signal loaded on the first common electrode line is −3V in the first stage and 3V in the second stage. Alternatively, the potential of the common electrode signal loaded on the second common electrode line is 3V in the first stage and 2V in the second stage.

Optionally, the difference between the absolute value of the potential of the common electrode signal loaded on the first common electrode line and the absolute value of the potential of the common electrode signal loaded on the second common electrode line may be not equal in the first stage and in the second stage.

Optionally, in the first stage, the difference range between the voltage between the first pixel electrode and the first common electrode and the voltage between the second pixel electrode and the second common electrode is (0, Vs]. It is assumed that Vs is equal to 4V. Then, in the first stage, the voltage between the first pixel electrode and the first common electrode is 4V, the voltage between the second pixel electrode and the second common electrode is 0V, and the difference between the two voltages is 4V.

Optionally, the voltage between the first pixel electrode and the first common electrode is 1.5 times to 4 times of the voltage between the second pixel electrode and the second common electrode. For example, in the first stage, the voltage between the first pixel electrode and the first common electrode may be 6V, the voltage between the second pixel electrode and the second common electrode may be 1.5V, and the voltage between the first pixel electrode and the first common electrode is 4 times of the voltage between the second pixel electrode and the second common electrode.

Figure 4:
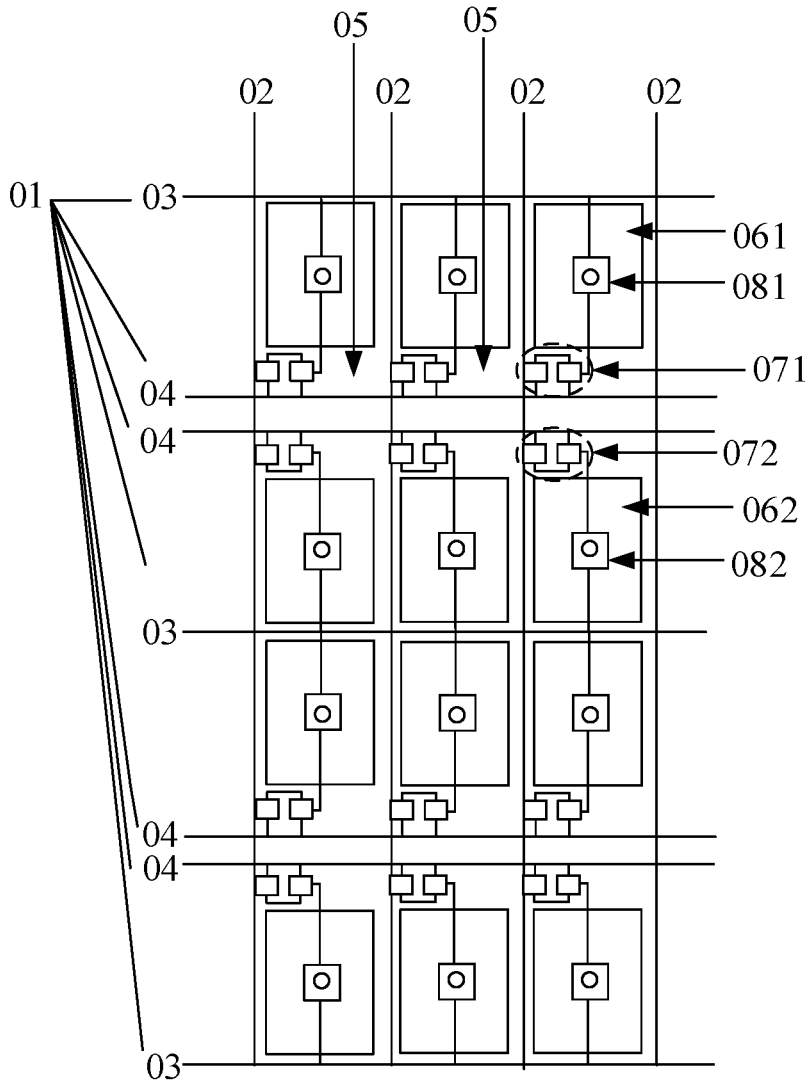
FIG. 4 is a schematic structural diagram of an array substrate of yet another display device according to an embodiment of the present disclosure.

FIG. 4 is a structural schematic diagram of yet another array substrate of a display device according to an embodiment of the present disclosure. The array substrate has a double-gate line structure, and the pixel unit included in the array substrate may include two sub-pixels: a first sub-pixel and a second sub-pixel. As shown in FIG. 4, the first sub-pixel includes a first pixel electrode 061, a first TFT 071, and a first common electrode 081. The second sub-pixel includes a second pixel electrode 062, a second TFT 072, and a second common electrode 082.

Here, the first electrode of the first TFT 071 is connected to the first data line, the second electrode of the first TFT 071 is connected to the first pixel electrode 061, and the gate electrode of the first TFT 071 is connected to the first gate line.

The first electrode of the second TFT 072 is connected to the second data line, the second electrode of the second TFT 072 is connected to the second pixel electrode 062, and the gate electrode of the second TFT 072 is connected to the second gate line. The first common electrode 081 may be connected to a first common electrode line, and the second common electrode 082 may be connected to a second common electrode line. For example, the second common electrode line and the first common electrode line are two different common electrode lines.

Exemplarily, the first data line connected to the first sub-pixel and the second data line connected to the second sub-pixel may be the same data line, the first gate line connected to the first sub-pixel and the second gate line connected to the second sub-pixel may be two different gate lines, and the first gate line is adjacent to the second gate line, that is, the first gate line and the second gate line are located between the first pixel electrode 061 and the second pixel electrode 062. That is, the first electrode of the first TFT 071 and the first electrode of the second TFT 072 may be connected to the same data line 02, and the gate electrode of the first TFT 071 and the gate electrode of the second TFT 072 may be connected to different gate lines 04.

In the first stage in which the first gray scale is displayed, for example, when the gray scale picture with the gray scale of 0~127 is realized, a first gate electrode scanning signal may be loaded to the first gate line in a first scanning period, and then the first gate electrode scanning signal is loaded to the gate electrode of the TFT 071 of the first sub-pixel by the first gate line, such that the TFT 071 is turned on. In this case, the first data line may provide a voltage signal to the first pixel electrode 061, such that the voltage between the first pixel electrode 061 and the first common electrode 081 is Vc. Here, if the voltage of the second common electrode 082 is 0, then the second gate line of the second sub-pixel can be turned off, and the second data line cannot charge the second pixel electrode 062, which is equivalent to that the voltage of the second sub-pixel is 0, that is, the voltage difference the second pixel electrode and the second common electrode is 0. Alternatively, if the voltage of the second common electrode 082 is not 0, then a second gate electrode scanning signal may be loaded to the second gate line, and the data signal is loaded to the second data line in the second scanning period, so that the second data line may charge the second pixel electrode 062 until the potential is equal to the potential of the second common electrode 082. In this case, the voltage between the second pixel electrode 062 and the second common electrode 082 is 0.

In the first stage, when the voltage between the first pixel electrode 061 and the first common electrode 081 is Vc, and the voltage between the second pixel electrode 062 and the second common electrode 082 is 0, the gray scale displayed by the first sub-pixel is 2p0, the gray scale displayed by the second sub-pixel is 0, and the first gray scale actually displayed by the pixel unit is p0. In addition, in the first stage, only the first sub-pixel emits light, and the second sub-pixel does not emit light.

Optionally, in the second stage in which the second gray scale is displayed, for example, when the gray scale picture with the gray scale of 128~255 is realized, the first gate electrode scanning signal is loaded to the first gate line in the first scanning period, and the second gate electrode scanning signal may be loaded to the second gate line in the second scanning period. Thus, in the first scanning period, the voltage signal may be provided to the first pixel electrode by the first data line, such that the voltage between the first pixel electrode and the first common electrode is the maximum gray scale voltage Vg, and the first sub-pixel realizes the display of the picture with the maximum brightness, that is, the gray scale displayed by the first sub-pixel is the maximum gray scale p. The voltage signal is provided to the second pixel electrode by the second data line in the second scanning period, so that the voltage between the second pixel electrode and the second common electrode is the voltage required when the display voltage is the displayed gray scale 2p0−p, that is, the gray scale displayed by the second sub-pixel is 2p0−p. Therefore, the pixel unit can realize the display of the picture corresponding to the second gray scale p0. In the second stage, both the first sub-pixel and the second sub-pixel emit light.

Optionally, in the embodiment of the present disclosure, when the first gate line and the second gate line are two different gate lines, the potentials of the common electrode signals loaded to the first common electrode line and the second common electrode line may be equal, that is, the potential of the first common electrode is equal to the potential of the second common electrode. In this case, the two gate lines can be respectively turned on in different scanning periods, so that the first pixel electrode and the second pixel electrode can be loaded with different potentials, and further the voltage between the first pixel electrode and the first common electrode is greater than or equal to the voltage between the second pixel electrode and the second common electrode.

In summary, the display device provided by the embodiment of the present disclosure includes an array substrate, and the pixel unit included in the array substrate includes a first sub-pixel and a second sub-pixel. The first sub-pixel includes a first pixel electrode and a first common electrode, and the second sub-pixel includes a second pixel electrode and a second common electrode. In the first stage, the voltage between the first pixel electrode and the first common electrode is greater than the voltage between the second pixel electrode and the second common electrode, and thus the gray scales displayed by the first sub-pixel and the second sub-pixel of the same pixel unit are also different. The gray scale actually displayed by each pixel unit is the average value of the gray scales displayed by the first sub-pixel and the second sub-pixel. Since the adjustment dimension of the average value is less than the adjustment dimension of the gray scale of each sub-pixel, by adjusting the voltage between the pixel electrode and the common electrode of each sub-pixel, finer dimension adjustment of the average value can be achieved, thereby increasing the change levels of the brightness and darkness of each pixel unit and improving the fineness of the display picture.

Moreover, since the voltages between the pixel electrodes and the common electrodes of the same pixel unit are different, for the liquid crystal molecules of the same pixel unit, the deflection angles of the liquid crystal molecules in different sub-pixels are different, and thus the change dimension of the average deflection angle of the liquid crystal molecules in the same pixel unit is finer. In this way, the levels of the brightness and darkness of the same pixel unit can be increased, thereby improving the degree of fineness of the display picture.

Figure 5:
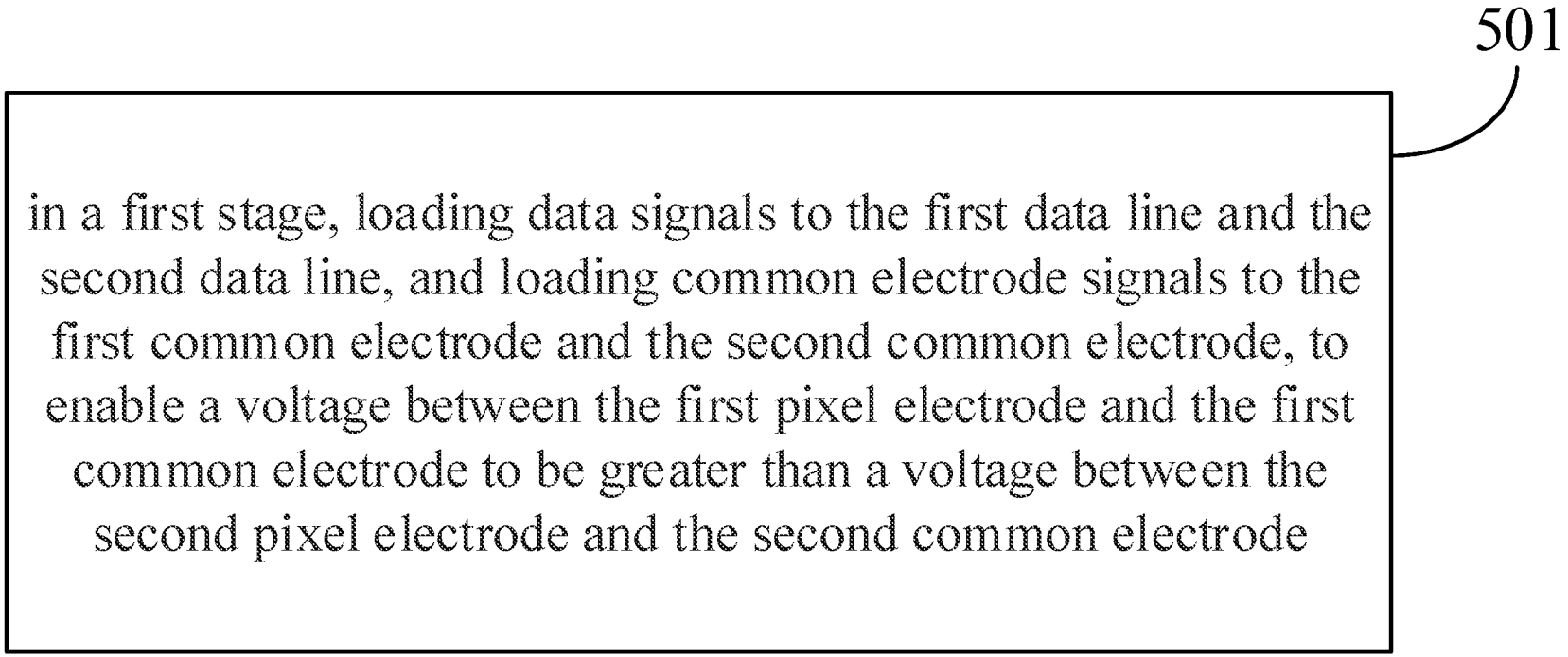
FIG. 5 is a flowchart of a driving method for an array substrate according to an embodiment of the present disclosure.

An embodiment of the present disclosure provides a driving method for an array substrate, which may be the array substrate shown in FIG. 1, FIG. 2 or FIG. 4. The array substrate includes a plurality of pixel units, and each of the pixel units includes a first sub-pixel and a second sub-pixel of the same color. The first sub-pixel includes a first pixel electrode and a first common electrode. The second sub-pixel includes a second pixel electrode and a second common electrode. The first sub-pixel is connected to a first data line, and the second sub-pixel is connected to a second data line. As shown in FIG. 5, the method may include the following steps.

In Step 501, in the first stage, data signals are loaded to the first data line and the second data line, and common electrode signals are loaded to the first common electrode and the second common electrode, such that the voltage between the first pixel electrode and the first common electrode is greater than the voltage between the second pixel electrode and the second common electrode.

In summary, with the driving method for an array substrate provided by the embodiment of the present disclosure, data signals can be loaded to the first data line and the second data line and common electrode signals can be loaded to the first common electrode and the second common electrode in the first stage, such that the voltage between the first pixel electrode and the first common electrode is greater than the voltage between the second pixel electrode and the second common electrode. The voltages between the pixel electrodes and the common electrodes of the same pixel unit are different, and thus the gray scales displayed by the first sub-pixel and the second sub-pixel of the same pixel unit are also different. The gray scale actually displayed by each pixel unit is the average value of the gray scales displayed by the first sub-pixel and the second sub-pixel. Since the adjustment dimension of the average value is less than the adjustment dimension of the gray scale of each sub-pixel, by adjusting the voltage between the pixel electrode and the common electrode of each sub-pixel, the finer dimension adjustment of the average value can be achieved, thereby increasing the change levels of the brightness and darkness of each pixel unit and improving the fineness of the display picture.

Moreover, since the voltages between the pixel electrodes and the common electrodes of the same pixel unit are different, for the liquid crystal molecules of the same pixel unit, the deflection angles of the liquid crystal molecules of different sub-pixels are different, and thus the change dimension of the average deflection angle of the liquid crystal molecules in the same pixel unit is finer. In this way, the levels of the brightness and darkness of the same pixel unit can be increased, thereby improving the fineness of the display picture.

Figure 6:
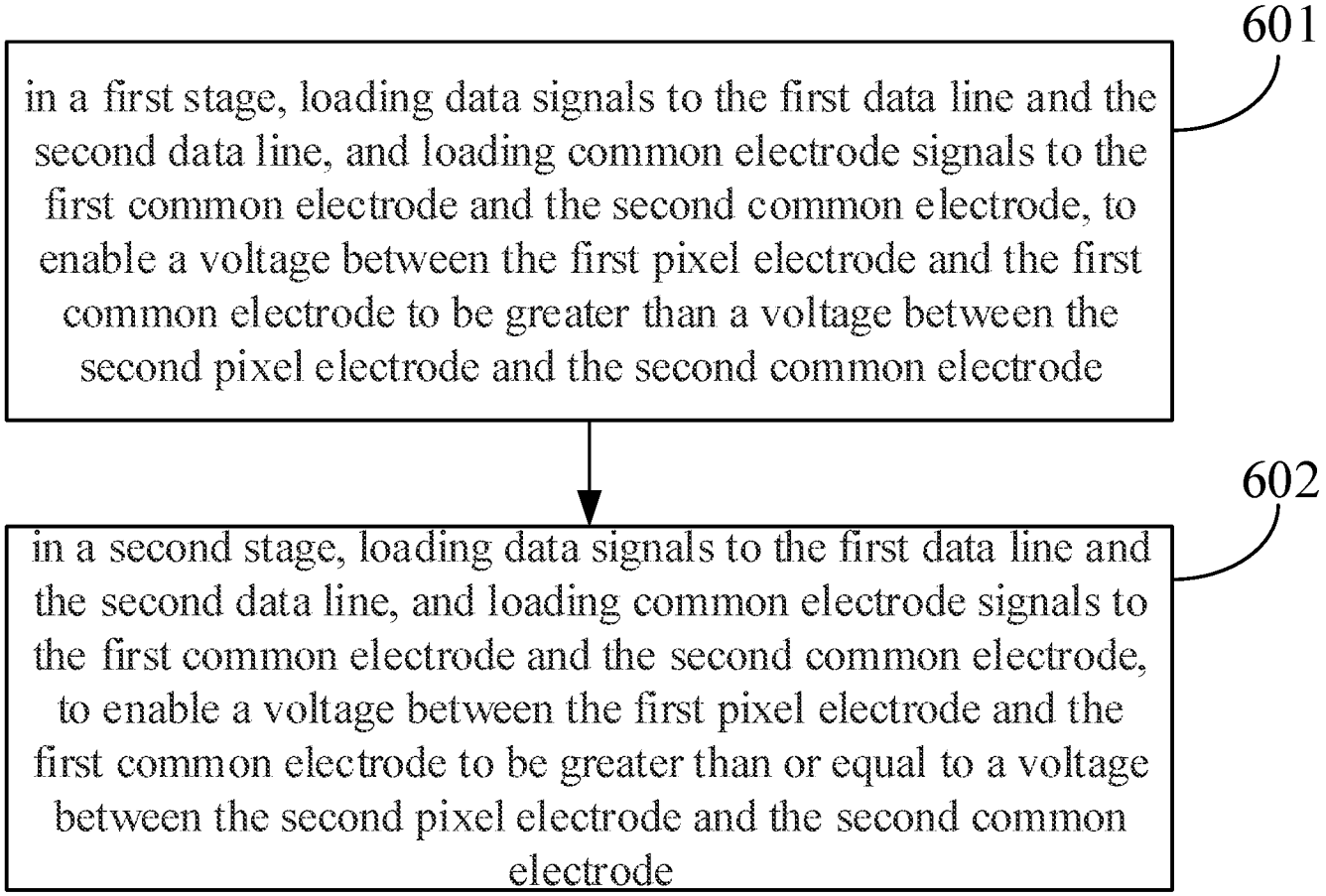
FIG. 6 is a flowchart of another driving method for an array substrate according to an embodiment of the present disclosure.

An embodiment of the present disclosure provides another driving method for an array substrate, which may be the array substrate as shown in FIG. 1, FIG. 2 or FIG. 4, As shown in FIG. 6, the method may include the following steps.

In Step 601, in the first stage, data signals are loaded to the first data line and the second data line, and common electrode signals are loaded to the first common electrode and the second common electrode, such that the voltage between the first pixel electrode and the first common electrode is greater than the voltage between the second pixel electrode and the second common electrode.

In Step 602, in the second stage, the data signals are loaded to the first data line and the second data line, and the common electrode signals are loaded to the first common electrode and the second common electrode, such that the voltage between the first pixel electrode and the first common electrode is greater than or equal to the voltage between the second pixel electrode and the second common electrode.

Here, the first stage may be a stage in which a first gray scale is displayed, and the second stage may be a stage in which a second gray scale is displayed, and the first gray scale is lower than the second gray scale. The range of the first gray scale may be (0, ½p], and the range of the second gray scale may be (½p, p], wherein p is the maximum gray scale that the display device is able to display.

Optionally, the polarities of the potentials of the common electrode signals loaded to the first common electrode and the second common electrode are opposite, and/or the absolute values of the potentials of the common electrode signals loaded to the first common electrode and the second common electrode are not equal.

For example, as shown in FIG. 3, the first data line connected to the first sub-pixel and the second data line connected to the second sub-pixel are two different data lines. Correspondingly, loading the data signals to the first data line and the second data line may include: loading the data signals to the first data line and the second data line in the same period.

Moreover, the first gate line connected to the first sub-pixel and the second gate line connected to the second sub-pixel may be the same gate line. After a gate electrode driving signal is loaded to the gate line, the TFT in the first sub-pixel and the TFT in the second sub-pixel may be enabled to be turned on simultaneously. The first data line can charge the first pixel electrode, and the second data line can charge the second pixel electrode. Therefore, the first pixel electrode and the second pixel electrode of the same pixel unit can be simultaneously charged by different data lines.

Optionally, the potentials of the data signals loaded to the first data line and the second data line may be different or the same. For example, when the potential of the first common electrode is equal to the potential of the second common electrode, the potentials of the data signals loaded to the first data line and the second data line may be different to ensure that the voltage of the first sub-pixel and the voltage of the second sub-pixels are not equal. When the potential of the first common electrode and the potential of the second common electrode are not equal, the potentials of the data signals loaded on the first data line and the second data line may be the same, thereby ensuring that the voltage of the first sub-pixel and the voltage of the second sub-pixel are not equal.

Exemplarily, as shown in FIG. 4, the first sub-pixel is further connected to a first gate line, the second sub-pixel is further connected to a second gate line, and the first gate line and the second gate line may be two different gate lines. Optionally, in at least one of the first stage and the second stage, the method may further include: loading a first gate electrode scanning signal to the first gate line in a first scanning period, and loading a second gate electrode scanning signal to the second gate line in a second scanning period.

The first scanning period and the second scanning period may be two different periods.

In the first stage, as an optional implementation, the first gate electrode scanning signal may be loaded to the first gate line only and the signal is prohibited from being loaded to the second gate line. In this case, the first data line may charge the first pixel electrode, the second data line cannot charge the second pixel electrode. The voltage of the second pixel electrode is 0.

As another optional implementation, the first gate electrode scanning signal may be loaded to the first gate line only and the signal is prohibited from being loaded to the second gate line in the first scanning period of the first stage. In this case, the first data line can charge the first pixel electrode. In the second scanning period of the first stage, the second gate electrode scanning signal is loaded to the second gate line only, and the signal is prohibited from being loaded to the first gate line. In this case, the second data line can charge the second pixel electrode. Therefore, the first pixel electrode and the second pixel electrode can be charged by different gate lines in different scanning periods.

In the second stage, in the first scanning period of the second stage, the first gate electrode scanning signal is loaded to the first gate line only, and the signal is prohibited from being loaded to the second gate line. In this case, the first data line can charge the first pixel electrode. In the second scanning period of the second stage, the second gate electrode scanning signal may be loaded to the second gate line only, and the signal is prohibited from loaded to the first gate line. In this case, the second data line can charge the second pixel electrode. For example, in the first scanning period, the first pixel electrode may be charged, such that the voltage between the first pixel electrode and the first common electrode is Vg, and the first sub-pixel displays the maximum gray scale p. In the second scanning period, the second pixel electrode may be charged, such that the voltage between the second pixel electrode and the second common electrode is the voltage Vp required when the displayed gray scale is p2=2p0−p, and the gray scale displayed by the second sub-pixel is 2p0−p.

For the driving method for an array substrate provided by any of the above embodiments, suitable common electrodes and data lines, etc. can be selected to load the potential according to the picture level or the fineness to be displayed.

Optionally, in at least one of the first stage and the second stage, the potential of the first pixel electrode is equal to the potential of the second pixel electrode, for example, in the second stage.

Alternatively, in at least one of the first stage and the second stage, the potential of the first common electrode is equal to the potential of the second common electrode, for example, in the first stage.

Optionally, in the second stage, the voltage between the first pixel electrode and the first common electrode may be greater than or equal to the voltage between the second pixel electrode and the second common electrode.

Optionally, at least one of the potentials of the common electrode signals loaded on the first common electrode line and the second common electrode line presents a periodic change in the first stage and the second stage. For example, the potential of the common electrode signal loaded on the first common electrode line is −3V in the first stage and 3V in the second stage. Alternatively, the potential of the common electrode signal loaded on the second common electrode line is 3V in the first stage and 2V in the second stage.

Optionally, the difference between the absolute value of the potential of the common electrode signal loaded on the first common electrode line and the absolute value of the potential of the common electrode signal loaded on the second common electrode line may be not equal in the first stage and the second stage.

Optionally, in the first stage, the data voltage Vd of the pixel unit corresponding to the picture actually displayed meets: when Vd≤Vs, the range of difference between the voltage between the first pixel electrode and the first common electrode and the voltage between the second pixel electrode and the second common electrode may be (0, Vg) or (0, Vc]. When the voltage between the second pixel electrode 062 and the second common electrode 082 is greater than or equal to 0, the range of the voltage between the first pixel electrode 061 and the first common electrode may be (0, Vs], that is, the first sub-pixel and the second sub-pixel may emit light at the same time.

For example, it is assumed that Vg is equal to 8V. In the first stage, the voltage between the first pixel electrode and the first common electrode is 4V, the voltage between the second pixel electrode and the second common electrode is 0V, and the difference between the two voltages is 4V, which is less than Vg.

Optionally, the voltage between the first pixel electrode and the first common electrode may be 1.5 times to 4 times of the voltage between the second pixel electrode and the second common electrode. For example, in the first stage, the voltage between the first pixel electrode and the first common electrode is 6V, and the voltage between the second pixel electrode and the second common electrode is 1.5V, and the voltage between the first pixel electrode and the first common electrode is 4 times of the voltage between the second pixel electrode and the second common electrode.

Optionally, in the second stage, when the data voltage Vd of the pixel unit corresponding to the picture actually displayed meets: Vd>Vs, the range of the voltage between the second pixel electrode and the second common electrode is (Vs, Vg], or (0, Vp]. Vp is the voltage required when the sub-pixel displays the gray scale of 2p0−p.

In summary, with the driving method for an array substrate provided by the embodiment of the present disclosure, data signals can be loaded to the first data line and the second data line and common electrode signals can be loaded to the first common electrode and the second common electrode in the first stage, such that the voltage between the first pixel electrode and the first common electrode is greater than the voltage between the second pixel electrode and the second common electrode. Thus, the gray scales displayed by the first sub-pixel and the second sub-pixel of the same pixel unit are also different, and the gray scale actually displayed by each pixel unit is the average value of the gray scales displayed by the first sub-pixel and the second sub-pixel. Since the adjustment dimension of the average value is less than the adjustment dimension of the gray scale of each sub-pixel, by adjusting the voltage between the pixel electrode and the common electrode of each sub-pixel, the finer dimension adjustment of the average value can be achieved, thereby increasing the change levels of the brightness and darkness of the pixel units, and improving the fineness of the display picture.

It should be noted that the magnitude of the potentials loaded to the data lines, the gate lines, the common electrode lines, etc., mentioned in the above are all illustrative. Unless otherwise stated, the magnitude of the voltages is not limited in the embodiment of the present disclosure.

Figure 7:
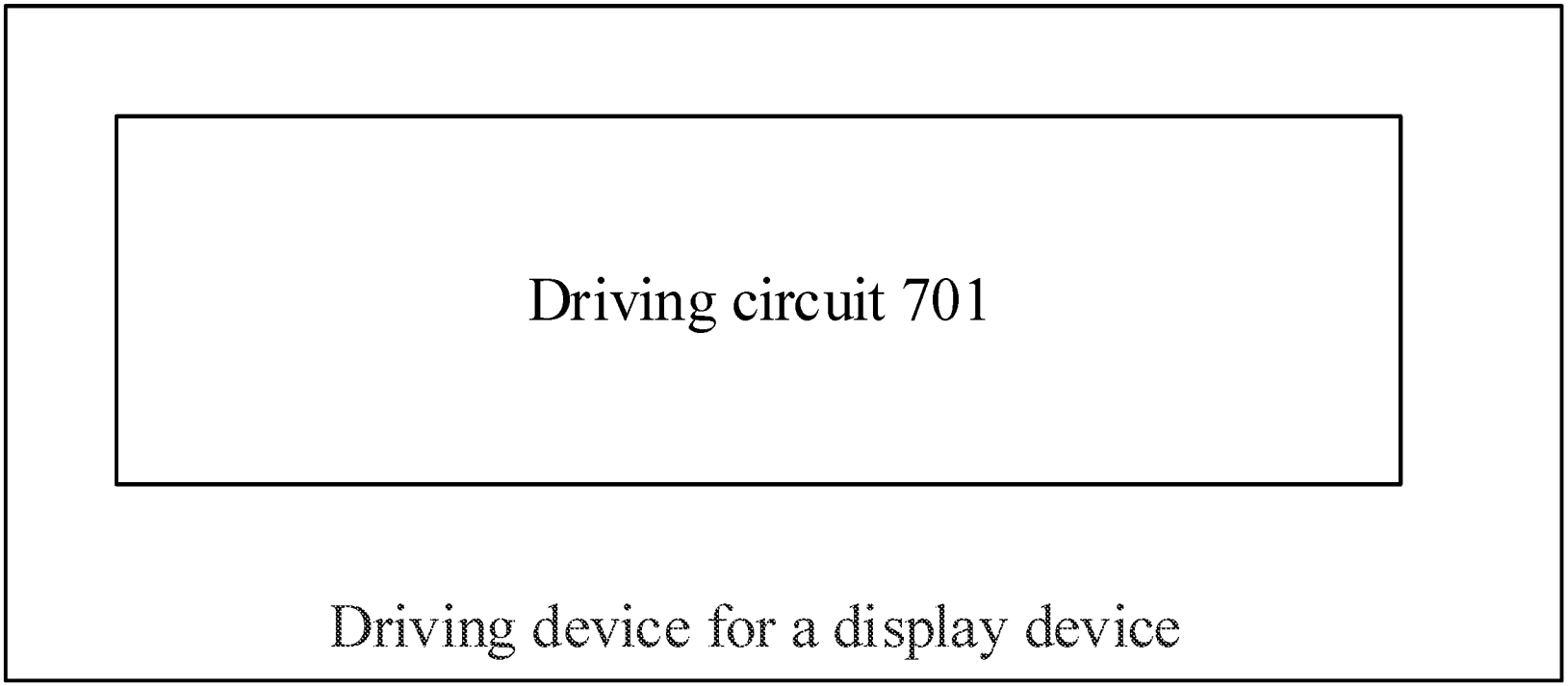
FIG. 7 is a structural schematic diagram of a driving device for an array substrate according to an embodiment of the present disclosure.

FIG. 7 is a structural schematic diagram of a driving device for an array substrate according to an embodiment of the present disclosure, and the array substrate may be the array substrate shown in FIG. 1, FIG. 2 or FIG. 4. The array substrate includes a plurality of pixel units. Each pixel unit includes a first sub-pixel and a second sub-pixel of the same color. The first sub-pixel includes a first pixel electrode and a first common electrode, and the second sub-pixel includes a second pixel electrode and a second common electrode. The first sub-pixel is connected to a first data line, and the second sub-pixel is connected to a second data line. As shown in FIG. 7, the driving device for the array substrate may include a driving circuit 701, configured to load data signals to the first data line and the second data line, and load common electrode signals to the first common electrode and the second common electrode in a first stage, so that the voltage between the first pixel electrode and the first common electrode is greater than the voltage between the second pixel electrode and the second common electrode.

Optionally, the driving circuit 701 is further configured to: in a second stage, load the data signals to the first data line and the second data line, and load the common electrode signals to the first common electrode and the second common electrode, such that the voltage between the first pixel electrode and the first common electrode is greater than or equal to the voltage between the second pixel electrode and the second common electrode.

The first stage is a stage in which a first gray scale is displayed, the second stage is a stage in which a second gray scale is displayed, and the first gray scale is lower than the second gray scale.

Optionally, the potentials of the common electrode signals loaded by the driving circuit 701 to the first common electrode and the second common electrode meet at least one of the following conditions.

The polarities of the potentials of the common electrode signals loaded to the first common electrode and the second common electrode are opposite.

The absolute values of the potentials of the common electrode signals loaded to the first common electrode and the second common electrode are not equal.

Optionally, the first data line and the second data line are two different data lines, and the process of loading, by the driving circuit 701, the data signals to the first data line and the second data line may include: loading data signals to the first data line and the second data line in the same period.

Optionally, the first sub-pixel may be connected to a first gate line, the second sub-pixel may be connected to a second gate line, and the first gate line and the second gate line are two different gate lines. In at least one of the first stage and the second stage, the driving circuit 701 may further be configured to load a first gate electrode scanning signal to the first gate line in a first scanning period; and load a second gate electrode scanning signal to the second gate line in a second scanning period.

Those skilled in the art could clearly understand that for the convenience and brevity of description, the specific working process of the above driving device and driving circuit may be made reference to the corresponding process in the foregoing method embodiments, and details are not repeated herein.

Figure 8:
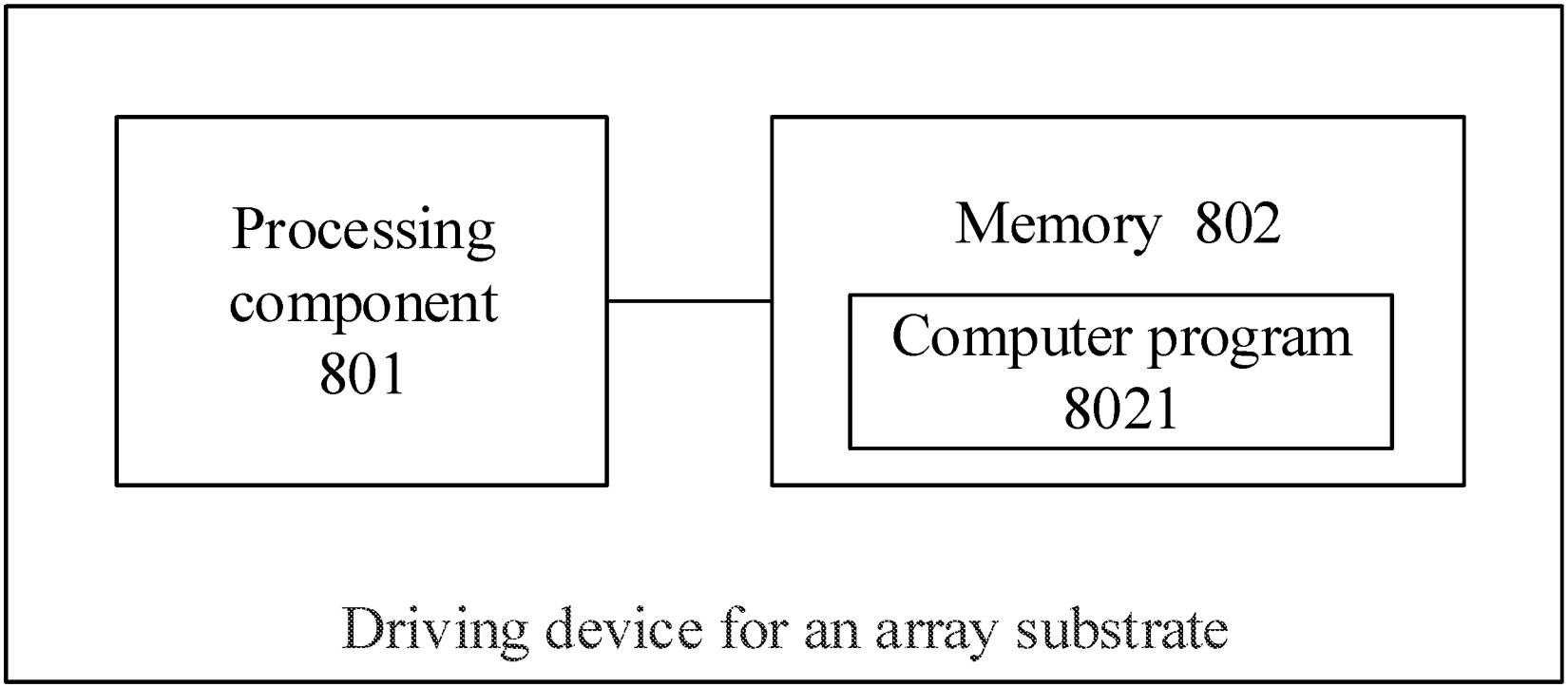
FIG. 8 is a structural schematic diagram of another driving device for an array substrate according to an embodiment of the present disclosure.

FIG. 8 is a structural schematic diagram of a driving device for an array substrate according to an embodiment of the present disclosure. The array substrate includes a plurality of pixel units. The pixel unit includes a first sub-pixel and a second sub-pixel. The first sub-pixel includes a first pixel electrode and a first common electrode. The second sub-pixel includes a second pixel electrode and a second common electrode. As shown in FIG. 8, the driving device may include: a processing component 801, a memory 802, and a computer program 8021 stored on the memory 802 and operable on the processing component. The processing component 801 implements the driving method for an array substrate provided by the foregoing method embodiments when executing the computer program 8021.

Optionally, the driving device may be a separately integrated chip in the display device, or may be integrated on a system on chip (SOC) or a graphics card of the display device. Or, the driving device may be a timing controller (TCON) or a microcontroller unit (MCU) integrated in the TCON.

An embodiment of the present disclosure further provides a display device. The display device may include the array substrate and the driving device for the array substrate provided in the foregoing embodiments. The display device may be any product or part with a display function, such as a liquid crystal panel, an electronic paper, a mobile phone, a tablet computer, a television, a display, a laptop computer, a digital photo frame and a navigator.

The embodiment of the present disclosure further provides a computer readable storage medium, storing instructions therein. The computer readable storage medium, when operated on a computer, causes the computer to implement the driving method for an array substrate provided by the above method embodiments.

The foregoing descriptions are only exemplary embodiments of the present disclosure, and are not intended to limit the present disclosure. Within the spirit and principles of the disclosure, any modifications, equivalent substitutions, improvements, etc., are within the protection scope of the present disclosure.

What is claimed is:

1. An array substrate, wherein the array substrate comprises a plurality of pixel units, each of the pixel units comprises a first sub-pixel and a second sub-pixel of the same color, the first sub-pixel comprises a first pixel electrode and a first common electrode, and the second sub-pixel comprises a second pixel electrode and a second common electrode, wherein, in a first stage in which the pixel unit displays a first gray scale, a voltage between the first pixel electrode and the first common electrode is greater than a voltage between the second pixel electrode and the second common electrode; and in a second stage in which the pixel unit displays a second gray scale, a voltage between the first pixel electrode and the first common electrode is greater than or equal to a voltage between the second pixel electrode and the second common electrode;

wherein the first gray scale is lower than the second gray scale, and a range of the first gray scale is (0, ½p, and a range of the second gray scale is (½p, p], wherein p is the maximum gray scale that the pixel unit is able to display.

2. The array substrate according to claim 1, wherein in the first stage, the voltage between the first pixel electrode and the first common electrode is less than or equal to Vg, wherein Vg is voltage required when a maximum gray scale is displayed; and in the second stage, the voltage between the first pixel electrode and the first common electrode is equal to Vg.

3. The array substrate according to claim 1, wherein in the first stage, a range of the voltage between the first pixel electrode and the first common electrode is (0, Vs], wherein Vs is voltage required when a displayed gray scale is half of a maximum gray scale; and in the second stage, a range of the voltage between the first pixel electrode and the first common electrode is (Vs, Vg], wherein Vg is voltage required when a maximum gray scale is displayed.

4. The array substrate according to claim 1, wherein the first sub-pixel and the second sub-pixel meet at least one of the following conditions:

a first common electrode line connected to the first common electrode in the first sub-pixel and a second common electrode line connected to the second common electrode in the second sub-pixel are two different common electrode lines;

a first data line connected to the first sub-pixel and a second data line connected to the second sub-pixel are two different data lines; and a first gate line connected to the first sub-pixel and a second gate line connected to the second sub-pixel are two different gate lines.

5. The array substrate according to claim 4, wherein the first data line and the second data line are the same data line; wherein the first gate line and the second gate line are two different gate lines.

6. The array substrate according to claim 4, wherein the first gate line and the second gate line are the same gate line; and the first data line and the second data line are two different data lines.

7. The array substrate according to claim 4, wherein the first common electrode line and the second common electrode line are two different common electrode lines; potentials of the first common electrode and the second common electrode meet at least one of the following conditions:

polarities of the potentials of the first common electrode and the second common electrode are opposite; and absolute values of the potentials of the first common electrode and the second common electrode are not equal.

8. The array substrate according to claim 4, wherein in the first stage, the voltage between the first pixel electrode and the first common electrode is less than or equal to Vg, and the voltage between the second pixel electrode and the second common electrode is 0; wherein Vg is voltage required when a maximum gray scale is displayed; and in the second stage in which the pixel unit displays a second gray scale, the voltage between the first pixel electrode and the first common electrode is equal to Vg, and the voltage between the second pixel electrode and the second common electrode is greater than 0.

9. The array substrate according to claim 1, wherein in the first stage, the voltage between the second pixel electrode and the second common electrode is 0; and in the second stage, the voltage between the second pixel electrode and the second common electrode is greater than 0.

10. A driving method for an array substrate, wherein the array substrate comprises a plurality of pixel units, each of the pixel units comprises a first sub-pixel and a second sub-pixel of the same color, the first sub-pixel comprises a first pixel electrode and a first common electrode, and the second sub-pixel comprises a second pixel electrode and a second common electrode, the first sub-pixel is connected to a first data line, and the second sub-pixel is connected to a second data line;

the method comprises:

in a first stage in which a first gray scale is displayed, loading data signals to the first data line and the second data line, and loading common electrode signals to the first common electrode and the second common electrode, to enable a voltage between the first pixel electrode and the first common electrode to be greater than a voltage between the second pixel electrode and the second common electrode, wherein the first sub-pixel is further connected to a first gate line, the second sub-pixel is further connected to a second gate line, the first gate line and the second gate line are two different gate lines; and in the first stage, the method further comprises:

loading a first gate electrode scanning signal to the first gate line in a first scanning period; and loading a second gate electrode scanning signal to the second gate line in a second scanning period.

11. The method according to claim 10, wherein the method further comprises:

in a second stage in which a second gray scale is displayed, loading data signals to the first data line and the second data line, and loading common electrode signals to the first common electrode and the second common electrode, to enable the voltage between the first pixel electrode and the first common electrode to be greater than or equal to the voltage between the second pixel electrode and the second common electrode; wherein the first gray scale is lower than the second gray scale.

12. The method according to claim 10, wherein potentials of the common electrode signals loaded to the first common electrode and the second common electrode meet at least one of the following conditions:

polarities of the potentials of the common electrode signals loaded to the first common electrode and the second common electrode are opposite; and absolute values of the potentials of the common electrode signals loaded to the first common electrode and the second common electrode are not equal.

13. The method according to claim 10, wherein the first data line and the second data line are two different data lines; and loading the data signals to the first data line and the second data line comprises:

loading the data signals to the first data line and the second data line in a same period.

14. A driving device for the array substrate, the driving device comprises a processor, a memory, and a computer program stored on the memory and executable on the processor, and the computer program, when executed by the processor, implements the driving method for the array substrate according to claim 10.

15. A computer readable storage medium storing instructions therein, wherein the computer readable storage medium, when operating on a computer, causes the computer to implement the driving method for an array substrate according to claim 10.

16. A driving device for an array substrate, wherein the array substrate comprises a plurality of pixel units, the pixel unit comprises a first sub-pixel and a second sub-pixel, the first sub-pixel comprises a first pixel electrode and a first common electrode, and the second sub-pixel comprises a second pixel electrode and a second common electrode, the first sub-pixel is connected to a first data line, and the second sub-pixel is connected to a second data line;

the driving device comprises:

a driving circuit, configured to load data signals to the first data line and the second data line, and load common electrode signals to the first common electrode and the second common electrode in a first stage in which a first gray scale is displayed, to enable a voltage between the first pixel electrode and the first common electrode to be greater than a voltage between the second pixel electrode and the second common electrode, and further configured to load data signals to the first data line and the second data line, and load common electrode signals to the first common electrode and the second common electrode in a second stage in which a second gray scale is displayed, to enable the voltage between the first pixel electrode and the first common electrode to be greater than or equal to the voltage between the second pixel electrode and the second common electrode:

wherein the first gray scale is lower than the second qray scale, and a range of the first gray scale is (0, ½p, and a range of the second gray scale is (½p, p], wherein p is the maximum gray scale that the pixel unit is able to display.

17. A display device, comprising the array substrate and the driving device for the array substrate according to claim 16.

* * * * *